US007281464B2

(12) United States Patent
Weiler, Jr. et al.

(10) Patent No.: US 7,281,464 B2
(45) Date of Patent: Oct. 16, 2007

(54) INLET MONITOR AND LATCH FOR A CRUST BREAKING SYSTEM

(75) Inventors: Charles A. Weiler, Jr., Holly, MI (US); Neil Russell, Bloomfield Hills, MI (US); Robert N. Winsand, Chicago, IL (US)

(73) Assignee: Ross Operating Valve Company, Troy, MI (US)

( * ) Notice: Subject to any disclaimer, the term of this patent is extended or adjusted under 35 U.S.C. 154(b) by 0 days.

(21) Appl. No.: 11/355,812

(22) Filed: Feb. 16, 2006

(65) Prior Publication Data

US 2007/0186763 A1 Aug. 16, 2007

(51) Int. Cl.
*F15B 15/26* (2006.01)
*C25C 3/14* (2006.01)

(52) U.S. Cl. ..... 91/44; 92/15; 92/30

(58) Field of Classification Search ..... 92/15, 92/30, 23, 20; 60/403, 406; 266/78; 91/44
See application file for complete search history.

(56) References Cited

U.S. PATENT DOCUMENTS 3,359,862 A * 12/1967 Modrich ..... 91/42
4,463,656 A * 8/1984 Mattsson ..... 91/448
4,700,612 A * 10/1987 Pfister ..... 91/448
5,163,353 A * 11/1992 Horstmann et al. ..... 91/448
6,649,035 B2 * 11/2003 Horstmann et al. ..... 204/245

FOREIGN PATENT DOCUMENTS

WO WO 8102044 A * 7/1981
WO WO-2007/042780 4/2007

OTHER PUBLICATIONS

Four Web Pages from www.norgren.com/n/aluminium/sector/latching.html for Norgren "Latching Mechanism—Pneumatically-Operated Mechanical Latch".

* cited by examiner

*Primary Examiner*—Thomas E. Lazo
(74) *Attorney, Agent, or Firm*—Honigman

(57) ABSTRACT

A system for selectively controlling movement of a piston between first and second positions, the system comprising a controller selectively actuated to enable fluid communication between a device and a source of pressurized fluid, a control valve for enabling fluid communication between a control system and the source of pressurized fluid, a sensing system for identifying the first and second positions, a monitoring valve selectively actuated by the at least one sensing valve for exhausting the flow of pressurized fluid, wherein the monitoring actuator remains actuated until the control valve is deactuated, and a latching mechanism selectively capable of engaging the piston when a loss of pressurized fluid has been identified.

24 Claims, 6 Drawing Sheets

INLET MONITOR AND LATCH FOR A CRUST BREAKING SYSTEM

TECHNICAL FIELD

The present invention generally relates to devices actuated by fluid power and more particularly to an air inlet monitor and latch for a crustbreaking system.

BACKGROUND

Valve systems are commonly used in various operations or processes for controlling the flow of fluid to and from a cylinder or other such actuating device having a movable work performing member or armature. However, the device is not constantly in motion, with the work performing member being held in a stationary position during various portions of the operation. Maintaining full line control pressure during periods when the movable work performing member is in the stationary position has been found to be wasteful of energy required to run compressors or other such sources of fluid power.

Fluid leakage inevitably occurs in the fluid power operated device or in related systems or subsystems. Maintaining full line control pressure and flow in order to compensate for such leakage has also been found to be expensive and wasteful in terms of energy usage, especially in systems such as those described above where a movable work performing member is required to be held in a stationary position during various portions of the operation of the system.

One particular system employing such devices is a system for processing molten metal. Typical processing systems include a large receptacle for retaining a mass of molten metal. The surface of the molten metal is generally exposed to atmosphere and thus exothermic heat transfer occurs from the mass, thereby cooling the top surface of the mass and forming a crust. The crust formation is detrimental to the material processing, thus fluid power operated devices are commonly employed for intermittently breaking the crust. As a result, energy is unnecessarily expended by maintaining the fluid power operated devices in a stationary position.

In the event that fluid pressure is lost within the fluid power operated devices, these devices may come into extended contact with the molten metal. This contact with the molten metal results in heat transfer from the mass to the devices and can cause the devices to become embedded in the molten metal. This type of contact has been found to reduce energy efficiency because additional heat is required to compensate for heat lost through the heat transfer.

SUMMARY OF THE INVENTION

The inventors of the present invention have recognized these and other problems associated with crustbreaking devices. To this end, the inventors have invented a system for selectively controlling movement of a piston between first and second positions, the system comprising a controller selectively actuated to enable fluid communication between a device and a source of pressurized fluid, a control valve for enabling fluid communication between a control system and a source of pressurized fluid, a sensing system for identifying either of the first and second positions of the piston and manipulating the source of pressurized fluid to the piston in response, a monitoring valve selectively actuated for exhausting the flow of pressurized fluid, and a latching mechanism selectively capable of engaging the piston when a loss of pressurized fluid occurs.

DETAILED DESCRIPTION

Figure 1:
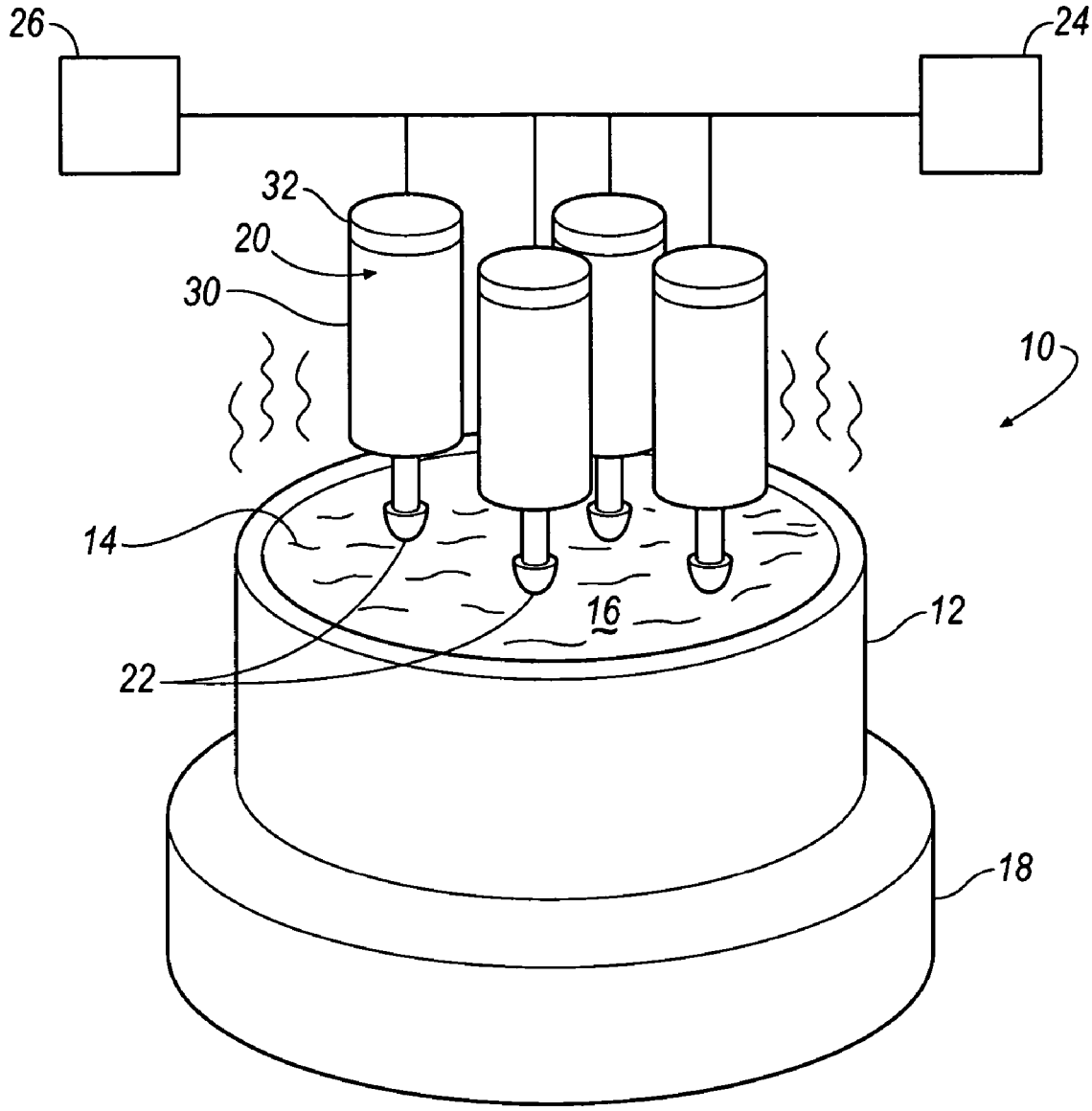
FIG. 1 is a perspective view of a smelting system for processing molten metals, including a crustbreaking device according to an embodiment of the invention.

With reference to FIG. 1, a system 10 is shown for processing fluid materials, more particularly, molten metal. In an exemplary embodiment, system 10 operates to process molten aluminum, however, it will be appreciated that any other molten metal or similar material may be substituted. With the exception of a latching mechanism, which is generally referenced at 149 in FIGS. 2-6 and discussed throughout the specification, the operation of the system 10 is similar to the operation of the system shown and described in U.S. Pat. No. 6,649,035, the contents of which is incorporated by reference and assigned to the assignee of the present disclosure.

System includes a pot 12 for retaining a mass 14 of molten metal. A top surface 16 of mass 14 is open to atmosphere, whereby heat transfer from mass 14 occurs resulting in a crust forming on the top surface 16 of mass 14. A heat source 18 is included and disposed generally below or around pot 12 for maintaining the temperature of mass 14 at or above a liquid transition temperature. Heat source 18 may provide any type of suitable heating, including induction or conduction heating. The liquid transition temperature may vary depending upon the particular material of mass 14. A plurality of crust breaking devices 20 are disposed above pot 12 and selectively engage top surface 16 of mass 14 for breaking up a crust, if formed on top surface 16. It can be appreciated that the number of crust breaking devices 20 may vary depending upon the area of top surface 16. A pick or other breaking tool 22 is attached to each crust breaking device 20 for disruptively engaging crust formed on top surface 16 of mass 14.

Crust breaking devices 20 are in electrical communication with a controller 24. Controller 24 controls the crust breaking devices 20 to move from a first position to a second position, or engage and withdraw from the crust formed top surface 16. Further, crust breaking devices 20 are each in fluid communication with a pressurized fluid source 26. Pressurized fluid source 26 may be, for example, compressed air, oil, water, or any other source of fluid power.

According to an exemplary embodiment, pressurized fluid source 26 may provide a pressurized flow of actuating fluid of approximately 100 psi. It will be appreciated that the 100 psi pressure is merely exemplary in nature and that the pressure may vary in accordance with design requirements.

The plurality of crust breaking devices 20 are of similar design and function as one another. Therefore, a single crust breaking device 20 will be described in detail herein. Crust breaking device 20 generally includes a working portion 30 and a control portion 32. Control portion 32 interconnects working portion 30 with the controller 24 and the pressurized fluid source 26. Furthermore, the control portion 32 controls the operation of the working portion 30 in three general modes: static, breaking and return. Each of the three modes is described in further detail below.

With reference to the Figures, working portion 30 of crust breaking device 20 includes a cylinder 34 having a cylindrical outer wall 36 and upper and lower end walls 38, 40 defining an internal chamber 42. A piston 44 is slidably disposed within internal chamber 42 and seals against an internal circumferential surface [not shown] of cylindrical outer wall 36. In this manner, piston 44 divides internal chamber 42 into upper and lower chambers 42*a*, 42*b*. Piston 44 is attached to a piston rod 48 that is slidably disposed through a central aperture 50 of lower end wall 40. Piston rod 48 is in sealed sliding engagement with aperture 50 to prohibit bleeding or leakage of pressurized fluid from lower chamber 42*b*. Breaking tool 22 is attached to the end of piston rod 48. Upper end wall 38 includes a fluid port 52 for providing pressurized driving fluid to drive piston 44 downward within internal chamber 42, from a first position within upper chamber 42*a* to a second position within lower chamber 42*b*. Lower end wall 40 includes a fluid port 54 for providing pressurized retracting fluid to retract piston 44 upward within internal chamber 42.

Control portion 32 of crust breaking device 20 includes first and second inlets 60, 62 in fluid communication with pressurized fluid source 26. First inlet 60 selectively provides pressurized fluid to control portion 32 through a control valve 64. Second inlet 62 provides pressurized fluid directly to a sensing system 55 having an upper sensing valve 56 and a lower sensing valve 58. Upper sensing valve 56 selectively directs pressurized fluid flow to a lower control valve 68 that further selectively directs pressurized fluid flow to lower chamber 42*b*. Upper control valve 66 selectively directs pressurized fluid flow to upper chamber 42*a* to move piston 44 to the second position within chamber 42*b*.

Upper sensing valve 56 is a two-position valve having a mechanical actuator 126 that is in mechanical communication with piston 44 of crust breaking device 20, through upper end wall 38. Upper sensing valve 56 further includes an inlet port 128, an outlet port 130 and a spring 132. Inlet port 128 is in fluid communication with second inlet 62 and outlet port 130 is in fluid communication with lower control valve 68. In a first, or an actuated position, inlet and outlet ports 128, 130 are not in fluid communication. Thus, pressurized fluid from second inlet 62 is prohibited from traveling through upper sensing valve 56 to lower control valve 68. In a second, or a deactuated position, fluid communication between inlet and outlet ports 128, 130 is complete, whereby pressurized fluid flows from second inlet 62 through upper sensing valve 56 to lower control valve 68.

More generally, the upper sensing valve 56 supplies air to the lower control valve 68. As the piston 44 returns and contacts the mechanical actuator 126, the upper sensing valve 56 is partially closed. In this manner, the pressure within the lower chamber 42*b* is regulated by the position of the upper sensing valve 56. In the event of leakage, the upper sensing valve 56 is partially open, providing sufficient pressure to support the piston 44 in the upper position.

Lower sensing valve 58 is a two-position valve having a mechanical actuator 134 that is in operable communication with piston 44 of crust breaking device 20 through lower end wall 40. Lower sensing valve 58 further includes an inlet port 136, an outlet port 138, an exhaust port 140 and a spring 142. Inlet port 136 is in fluid communication with second inlet 62, outlet port 138 is in fluid communication with pilot port 76 of monitoring valve 70 through shuttle valve 98, and exhaust port 140 is in fluid communication with an exhaust to atmosphere. Outlet port 138 is in selective fluid communication with inlet and exhaust ports 136, 140. In a first, or a deactuated position, inlet and outlet ports 136, 138 are not in fluid communication. Thus, pressurized fluid from inlet 62 is exhausted through lower sensing valve 58. In a second, or an actuated position, inlet and outlet ports 136, 138 are in fluid communication.

Control valve 64 is a two-position valve including a solenoid actuated pilot 78 that is selectively actuated by a solenoid 80. Solenoid 80 is in electrical communication with and is actuated by controller 24. Control valve 64 includes an inlet port 82, an exhaust port 84, an outlet port 86, and a spring 88. Inlet port 82 is in direct fluid communication with first inlet 60. Control valve 64 is biased to a first, or a deactuated position by spring 88. Thus, inlet port 82 is blocked, thereby prohibiting the flow of pressurized fluid, and exhaust port 84 is in communication with outlet port 86. In this manner, any fluid pressure at pilot ports 72, 74 is exhausted to atmosphere through monitoring valve 70. In a second, or an actuated position, inlet and outlet ports 82, 86 are in fluid communication. Thus, pressurized fluid is able to flow from first inlet 60 through control valve 64. It will be appreciated, however, that control valve 64 provides an exemplary mechanism for controlling inlet flow of pressurized fluid.

A control system 65 includes upper control valve 66 and lower control valve 68. Upper control valve 66 is a two position valve that includes pilot port 72, which is in fluid communication with first inlet 60. Pilot 72 selectively actuates upper control valve 66 from a first, or a deactuated position to a second, or an actuated position. Upper control valve 66 further includes an inlet port 110, an exhaust 112, an outlet port 114, and a biasing member 108. Outlet port 114 is in substantially constant fluid communication with fluid port 52 of upper end wall 38 and is in selective fluid communication with inlet and exhaust ports 110, 112. Exhaust port 112 is in fluid communication with an exhaust to atmosphere.

Lower control valve 68 is a two-position valve that includes pilot port 74 which is in fluid communication with inlet control valve 64. Pilot port 74 selectively displaces lower control valve 68 from a first, or deactuated position to a second, or an actuated position. Lower control valve 68 further includes an inlet port 120, an exhaust port 122, an outlet port 124 and a spring 118. Outlet port 124 is in substantially constant fluid communication with fluid port 54 of lower end wall 40 and is in selective fluid communication with inlet and exhaust ports 120, 122. Exhaust port 122 is in fluid communication with an exhaust to atmosphere while inlet port 120 is in direct fluid communication with upper sensing valve 56.

Monitoring valve 70 includes four ports that are selectively in fluid communication with one another. A first port 90 is in fluid communication with outlet port 86 of control valve 64; a second port 92 is in fluid communication with pilots 72, 74 of upper and lower control valves 66, 68; a third port 94 is in indirect fluid communication with pilot port 76 of monitoring valve 70 though a shuttle valve 98; and a fourth port 96 is in fluid communication with an exhaust to atmosphere. In a first or a deactuated position, monitoring valve 70 enables fluid flow between first and second pilot ports 72, 74 through control valve 64 to exhaust and fluid communication between the third and fourth ports 94, 96 to exhaust. In a second, or actuated position, monitoring valve 70 enables fluid flow between first and third ports 90, 94 and second and fourth ports 92, 96.

Figure 2:
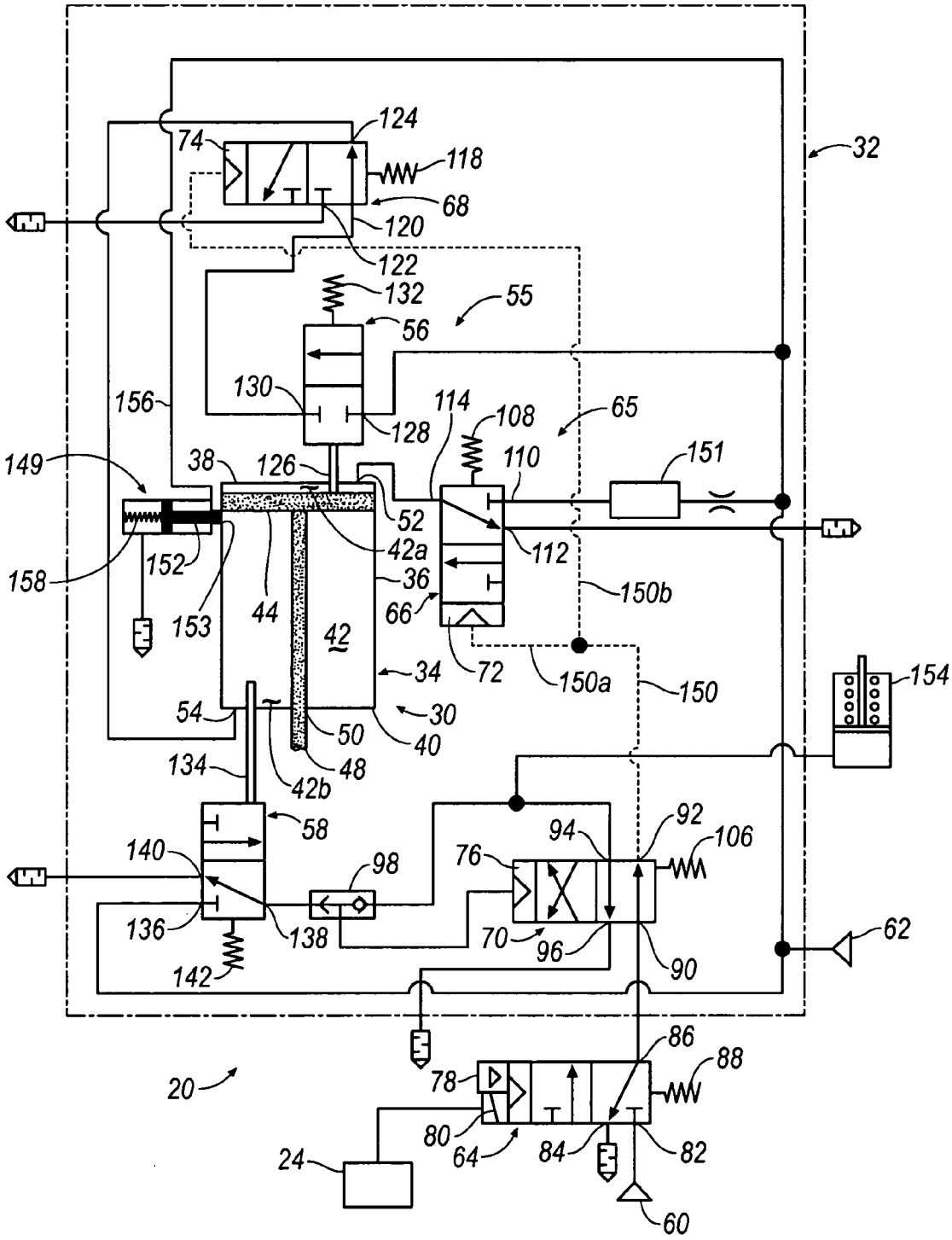
FIG. 2 is a schematic view of a crust breaking device in an operating mode according to an embodiment of the invention.

Referring to FIG. 2, during the static mode, control portion 32 maintains piston 44 in an upper-most position within internal chamber 42, whereby breaking tool 22 is retracted from engagement with crust formed on top surface 16 of mass 14. This is achieved by the lower chamber 42*b* being filled with the pressurized fluid, having sufficient lifting pressure, and the upper chamber 42*a* being exhausted of pressurized fluid.

In such a situation, lower sensing valve 58 is biased to a deactuated position by the spring 142, whereby outlet port 138 is in fluid communication with exhaust port 140 for exhausting pilot port 76 of monitoring valve 70 to atmosphere. Lower control valve 68 remains in the deactuated position, whereby outlet port 124 is in fluid communication with inlet port 120. Fluid pressure to lower control valve 68 is blocked, thus trapping pressure in lower chamber 42*b* to maintain piston 44 in an upward position.

Upper sensing valve 56 is biased in the first position by mechanical actuator 126. Upper control valve 66 remains in the first position, whereby outlet port 114 is in fluid communication with exhaust port 112. In this manner, upper chamber 42*a* is exhausted to atmosphere.

In case of system 10 bleeding and downward travel of piston 44 within chamber 42, mechanical actuator 126 of upper sensing valve 56 loses contact with piston 44 and spring 132 biases upper sensing valve 56 toward the deactuated position. In this manner, pressurized fluid passes through upper sensing valve 56 and lower control valve 68 into lower chamber 42*b* for urging piston 44 upwardly to the first position within upper chamber 42*a*.

Figure 3:
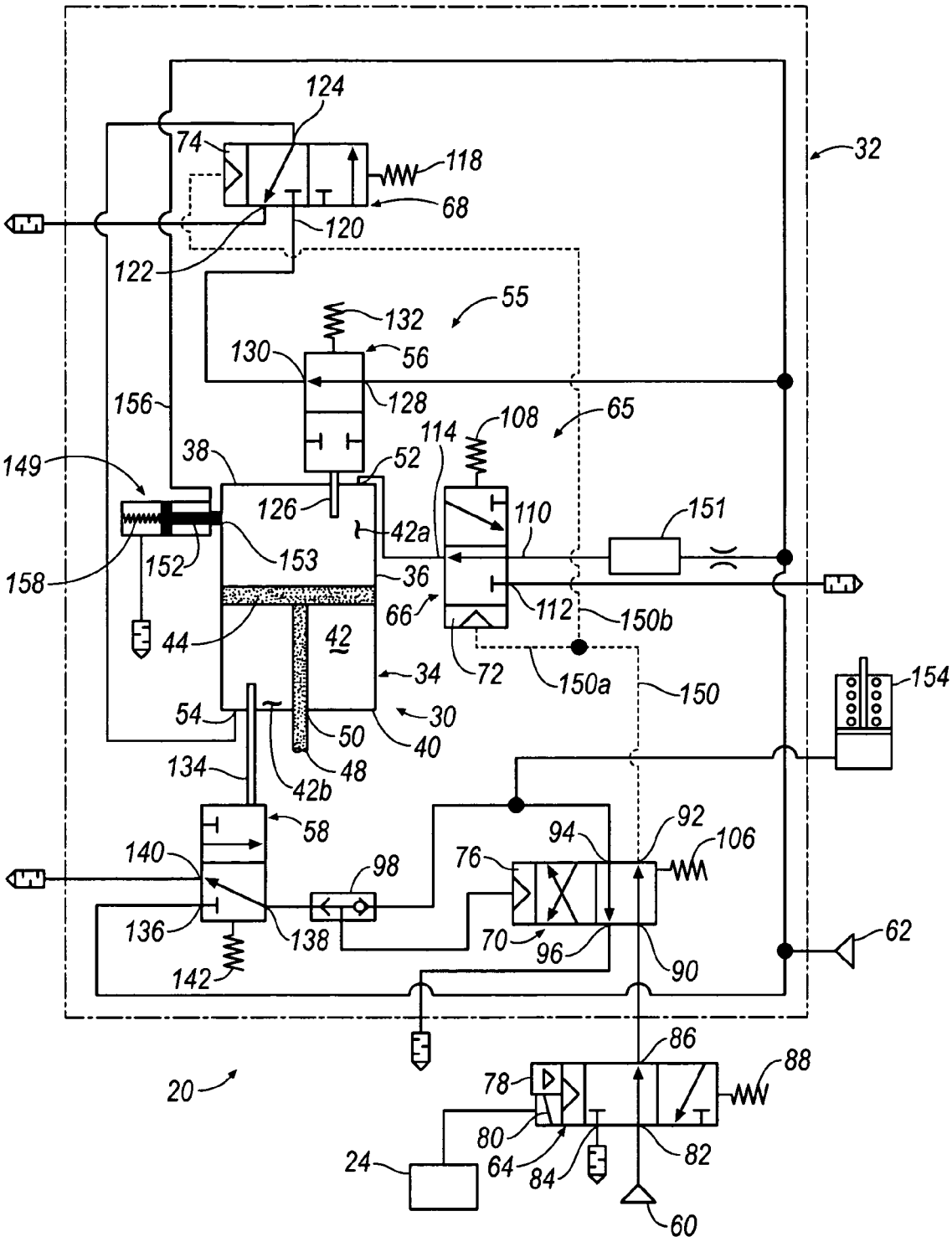
FIG. 3 is a schematic view of the crust breaking device in an operating mode according to an embodiment of the invention.

FIG. 3 illustrates the breaking mode. Controller 24 periodically signals activation of crust breaking device 20 in the breaking mode. Signaling of the breaking mode may occur for one of several reasons, including a schedule, sensors sensing the condition of the mass 14, or the like. Controller 24 signals solenoid 80 of control valve 64, which displaces control valve 64 to the actuated position. In the actuated position, inlet port 82 is in fluid communication with outlet port 86 to enable the flow of pressurized fluid from first inlet 60 through control valve 64. The pressurized fluid flows through the monitoring valve 70 and through a path 150 that splits into first and second paths 150*a*, 150*b*. Pressurized fluid flows through the first path 150*a* to pilot port 72 of upper control valve 66 and through the second path 150*b* to pilot port 74 of lower control valve 68. The pressurized fluid concurrently displaces upper and lower control valves 66, 68 to their actuated positions.

Displacing upper control valve 66 to the actuated position blocks exhaust port 112 and enables fluid communication between inlet and outlet ports 110, 114. In this manner, pressurized fluid flows from second inlet 62, through upper control valve 66 and into upper chamber 42*a*, through fluid port 52. An optional volume source 151 may be included for introducing a stored, pressurized fluid directed through upper control valve 66 to expedite downward travel of piston 44.

The pressurized fluid flowing into upper chamber 42*a* forces downward travel of piston 44 to the second position within lower chamber 42*b*. Concurrent displacement of lower control valve 68 to the actuated position blocks inlet port 120 and enables fluid communication between outlet and exhaust ports 122, 124. As piston 44 travels downward, pressurized fluid in lower chamber 42*b* is exhausted out fluid port 54 of lower end wall 40, through lower control valve 68, and out to atmosphere through exhaust 122. In this manner, piston 44 is able to drive breaking tool 22 downward into crust formed top surface 16, thus breaking the crust. The intake of pressurized fluid into upper chamber 42*a* prevents suction action from occurring, which would act to slow the downward travel of piston 44. Further, if the downward travel of piston 44 is insufficient for breaking crust formed on top surface 16, the pressurized air provides added force.

It should also be noted that downward travel of piston 44 deactuates upper sensing valve 56, enabling pressurized fluid flow to lower control valve 68 where it is blocked at port 120. Thus, substantially no flow to lower chamber 42*b* can occur until lower control valve 68 is deactuated.

Figure 4:
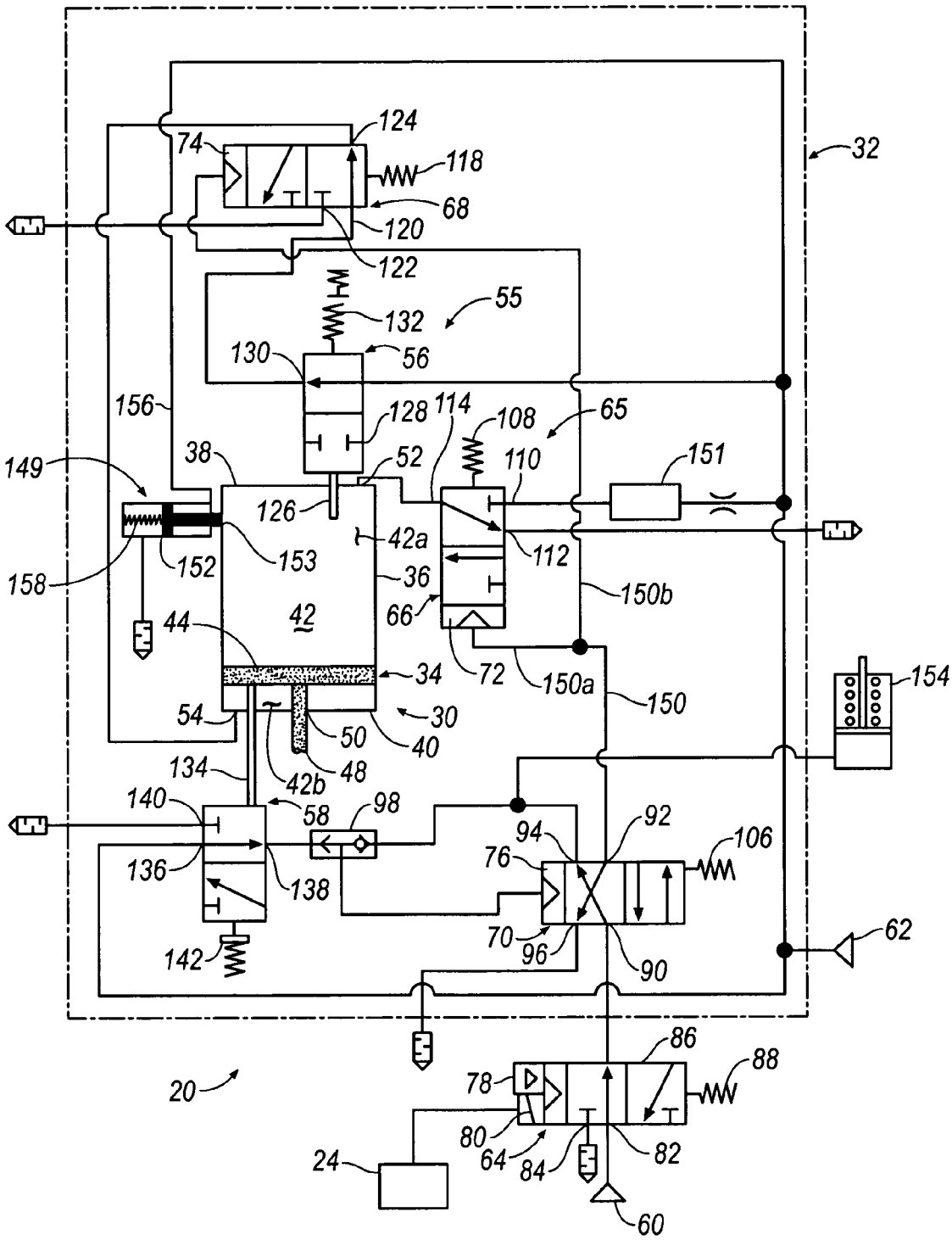
FIG. 4 is a schematic view of the crust breaking device in an operating mode according to an embodiment of the invention.

FIG. 4 illustrates the return mode, which is initiated by piston 44 interfacing with mechanical actuator 134 of lower sensing valve 58, thus displacing lower sensing valve 58 to the actuated position. Actuation of lower sensing valve 58 blocks exhaust port 140 and enables fluid communication between inlet and outlet ports 136, 138. In this manner, pressurized fluid flows from second inlet 62, through lower sensing valve 58, through shuttle valve 98, to pilot port 76 of monitoring valve 70 to actuate monitoring valve 70. Actuating monitoring valve 70 enables fluid flow between first and third ports 90, 94 and second and fourth ports 92, 96. In this manner, pressurized fluid is directed through monitoring valve 70 to an ore feed cylinder 154 or an ore feed valve (not shown) and to pilot port 76 of monitoring valve 70 through shuttle valve 98. Further, the pressurized fluid applied to pilot ports 72, 74 of upper and lower control valves 66, 68 is exhausted through monitoring valve 70.

With the pressurized fluid exhausted from pilot ports 72, 74, upper and lower control valves 66, 68 are biased into their respective deactuated positions by their respective springs 108, 118. In the deactuated position, the upper control valve 66 blocks the flow of pressurized fluid into the upper chamber 42*a* and provides an exhaust path via fluid port 54 for the residual pressurized fluid in the upper chamber 42*a*. Concurrently, pressurized fluid flows through upper sensing valve 56, through lower control valve 68 and into lower chamber 42*b* for urging piston 44 upward within chamber 42 to the first position within upper chamber 42*a*. As piston 44 travels upward, residual fluid in upper chamber 42*a* is exhausted through upper control valve 66 via port 52.

Upward travel of piston 44 enables spring 142 to deactuate lower sensing valve 58. Thus, pressurized fluid flow from second inlet 62 through lower sensing valve 58 and to pilot 76 of monitoring valve 70 is blocked and pressurized fluid at one input to shuttle valve 98 is exhausted to atmosphere. However, pilot port 76 of monitoring valve 70 is not immediately deactuated. Instead, the pressurized fluid flow between first and third ports 90, 94 of monitoring valve 70 shifts shuttle valve 98 and is applied to pilot port 76 of monitoring valve 70.

When piston 44 reaches the top of chamber 42, upper sensing valve 56 is actuated and moves to its first position and modulates pressurized fluid flow through to lower chamber 42*b*. Thus, piston 44 is held within upper chamber 42*a*. As a result of the substantially immediate actuation of the return mode, breaking tool 22 is exposed to mass 14 for a limited time. In this manner, heat transfer resulting from exposure of the breaking tool 22 to the mass 14 is significantly reduced, thereby providing a more energy efficient system.

After a predetermined time, controller 24 deactuates solenoid 80 and spring 88 biases the control valve 64 to the deactuated position. In the deactuated position, flow of pressurized fluid from first inlet 60 is blocked and residual pressurized fluid is directed through control valve 64 to exhaust. Eventually, the residual pressurized fluid can no longer maintain actuation of monitoring valve 70 against the bias of spring 106. Thus, monitoring valve 70 shifts to the deactuated position and control portion 32 returns to the static mode. It should be noted that monitoring valve 70, with its respective fluid flows, is designed to be part of a holding circuit, whereby deactuation only occurs upon deactuation of control valve 64.

Figure 5A:
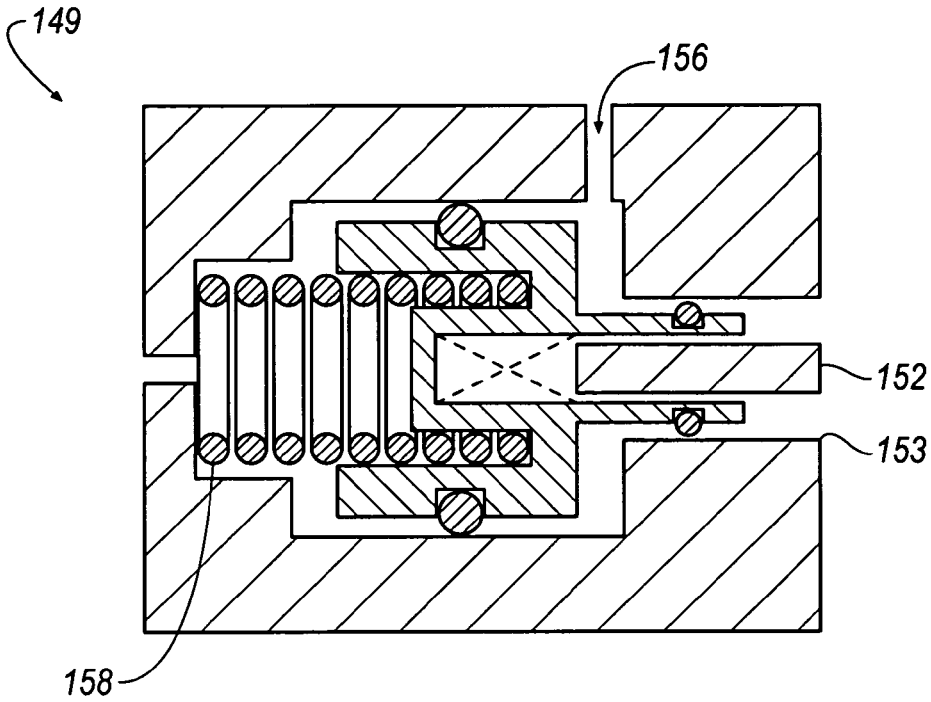
FIG. 5A is an exploded view of a latch mechanism in a deactuated position according to an embodiment of the invention.
Figure 5B:
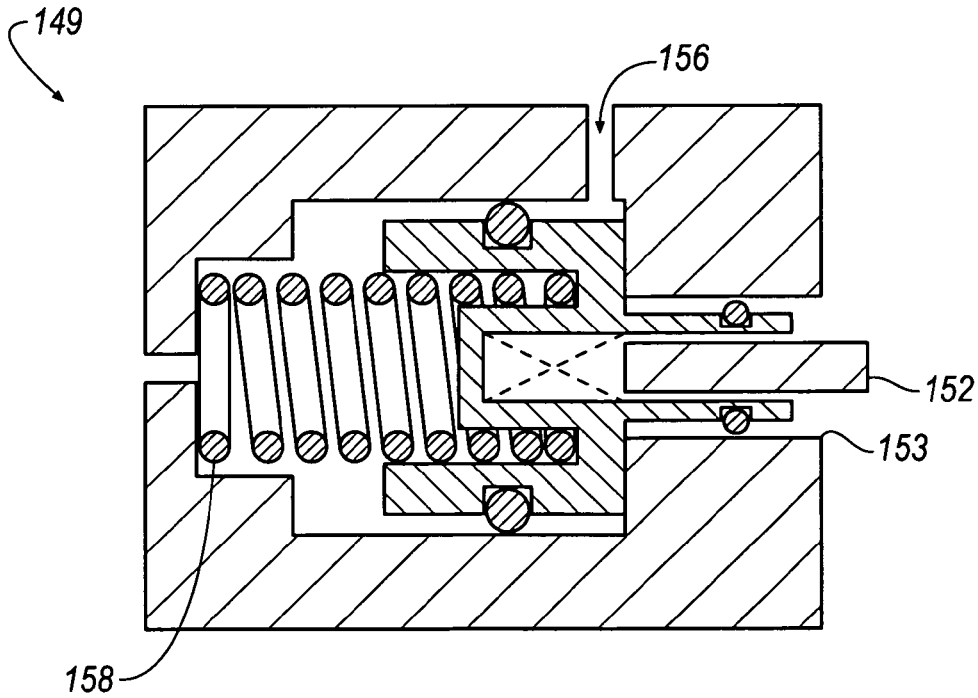
FIG. 5B is an exploded view of a latch mechanism in an actuated position according to an embodiment of the invention.

System 10 further includes a latching mechanism 149. Referring now to FIGS. 5A and 5B, latching mechanism 149 is a two-position valve having a mechanical latch 152 that is in selective communication with piston 44 of crust breaking device 20. Latching mechanism 149 includes an inlet port 156 which is in direct or indirect fluid communication with first and second inlets 60, 62 and a spring 158. Fluid pressure from first and second inlets 60, 62 provides a force against spring 158 to maintain mechanical latch 152 in a first or a deactuated position.

Mechanical latch 152 is capable of moving from a first position to a second, or actuated position to engage piston 44. When mechanical latch 152 moves to the second position, mechanical latch 152 passes through an aperture 153 on cylinder 34 and is partially disposed within internal chamber 42. Mechanical latch 152 is in sealed sliding engagement with an aperture 153 to prohibit bleeding or leakage of pressurized fluid from chamber 42.

Figure 6:
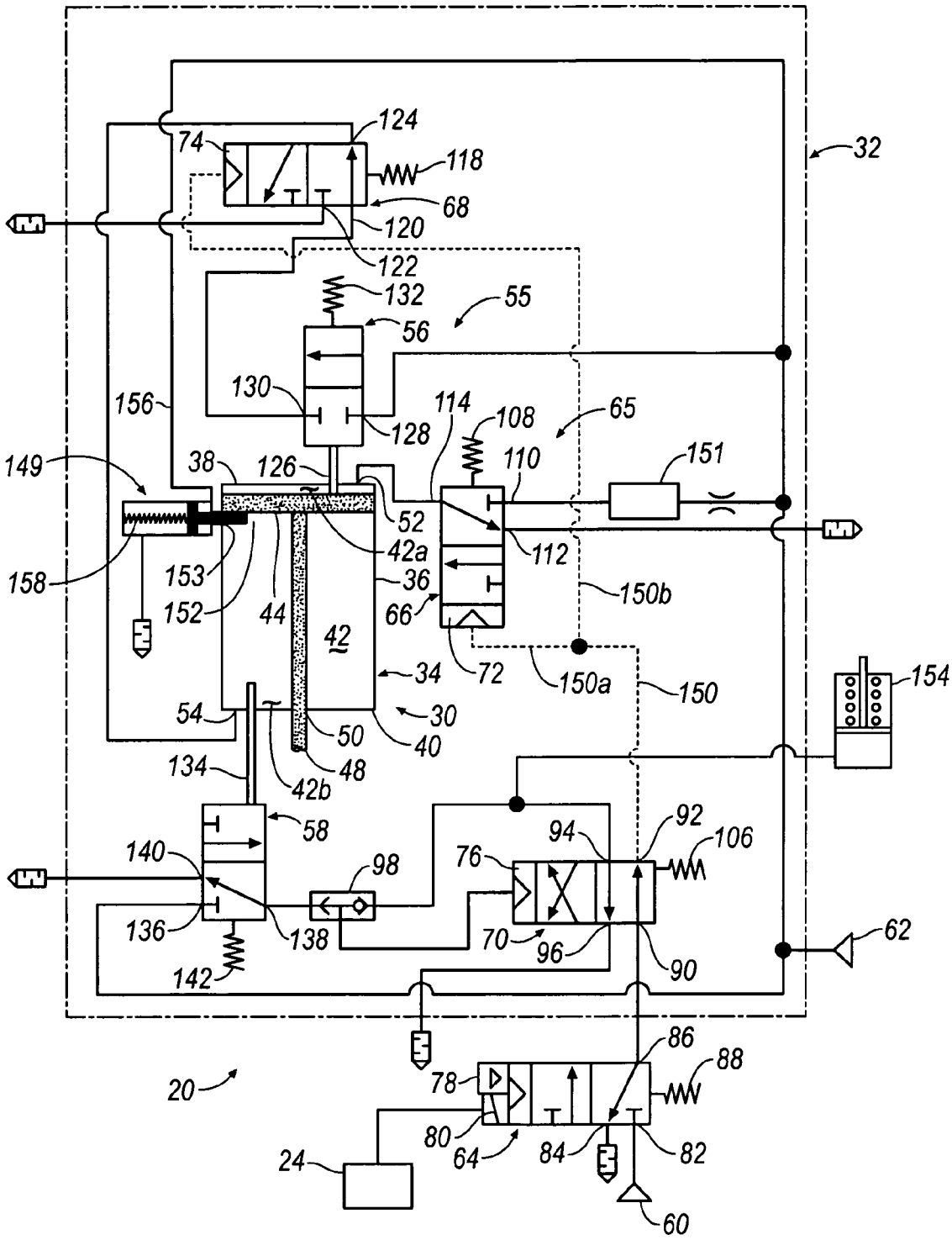
FIG. 6 is a schematic view of the crust breaking device with the latch in an actuated position according to an embodiment of the invention.

Referring to FIG. 6, when there is a loss of fluid pressure in either first or second inlets 60, 62, mechanical latch 152 of latching mechanism 149 engages the piston 44 to prevent crust breaking device 20 of piston 44 from traveling downward into mass 14. In such a situation, as fluid pressure from first or second inlets 60, 62 to inlet port 156 decreases, the force exerted by the fluid pressure against spring 158 also proportionally decreases. In the event the fluid pressure continues to decrease beyond a predetermined amount, the biasing force of spring 158 overcomes the force exerted by the fluid pressure from inlet ports 60, 62 through inlet port 156, thereby causing mechanical latch 152 to move from the first position to the second position. As a result, mechanical latch 152 passes through aperture 153 to engage piston 44, thereby preventing piston 44 from traveling further down chamber 42.

When fluid pressure is recovered above the predetermined amount, the force exerted by the fluid pressure from inlet ports 60, 62 through inlet port 156 will overcome the biasing force of spring 158, thereby causing spring 158 to move back to the first position. As a result, mechanical latch 152 will disengage piston 44, allowing piston 44 to move between upper and lower chambers 42*a*, 42*b*.

While FIG. 6 illustrates mechanical latch 152 as including an extendable pin, mechanical latch 152 is not limited in design to the illustrated figure. It can be appreciated that mechanical latch 152 may be of any design, so long as mechanical latch 152 is capable of engaging piston 44 to restrict the movement of piston 44 within chamber 42.

The embodiments disclosed herein have been discussed for the purpose of familiarizing the reader with novel aspects of the invention. Although preferred embodiments of the invention have been shown and described, many changes, modifications and substitutions may be made by one having ordinary skill in the art without necessarily departing from the spirit and scope of the invention as described in the following claims.

The invention claimed is:

1. A system for selectively controlling movement of a piston between first and second positions, the system comprising:

a cylinder defining an internal chamber, wherein the piston is slidably-disposed within the internal chamber;

a controller selectively actuated to enable fluid communication between a device and a source of pressurized fluid;

a control valve selectively actuated to enable fluid communication between a control system and the source of pressurized fluid, the control system selectively drives the piston between the first and second positions in response to the control valve;

a monitoring valve selectively actuated for exhausting the flow of pressurized fluid, wherein the monitoring valve remains actuated until the control valve is deactuated;

a sensing system for manipulating the source of pressurized fluid to the control system and the monitoring valve; and a latching mechanism positioned externally with respect to said cylinder, wherein the latching mechanism includes a latch that is selectively capable of engaging the piston through the cylinder when a loss of pressurized fluid occurs.

2. The system of claim 1, wherein the control system comprises:

a lower control valve selectively actuated for enabling the flow of pressurized fluid to a lower chamber of the working portion for driving the piston to the first position;

an upper control valve selectively actuated for enabling the flow of pressurized fluid to an upper chamber of the working portion for driving the piston to the second position.

3. The system of claim 2, wherein each of the upper and lower control valves further include a pilot in fluid communication with the monitoring valve.

4. The system of claim 1, wherein the sensing system comprises:

an upper sensing valve selectively actuated by the control valve for enabling the flow of pressured fluid to the upper control valve; and a lower sensing valve selectively actuated by the monitoring valve for enabling the flow of pressurized fluid to an ore feed cylinder and the monitoring valve.

5. The system of claim 4, wherein the upper sensing valve is in fluid communication between the lower control valve and the source of pressurized fluid.

6. The system of claim 4, wherein the second sensing valve is in fluid communication between the monitoring valve and the source of pressurized fluid.

7. The system of claim 1, wherein the latch is in operable communication with the source of pressurized fluid; wherein the latching mechanism further comprises a biasing member in operable communication with the latch and the source of pressurized fluid for enabling the latch to selectively engage the piston.

8. The system of claim 7, wherein the biasing member selectively enables the latch to engage the piston when the system experiences a loss of pressurized fluid.

9. The system of claim 1, wherein the cylinder further comprises:

an outer wall, an upper end wall, and a lower end wall, wherein the outer wall includes an aperture, wherein the outer wall, upper end wall and lower end wall define said internal chamber, wherein the latch is aligned with said aperture, wherein the latch selectively engages the piston through said aperture.

10. The system of claim 1, wherein the latch is selectively capable of engaging the piston within said internal chamber.

11. A system for selectively controlling movement of a piston and a device between first and second positions, the system comprising:

a controller selectively actuated to enable fluid communication between the device and a source of pressurized fluid;

a control portion selectively connecting a working portion of the device with the controller and the source of pressurized fluid, wherein the working portion further includes a cylinder defining an internal chamber, wherein the piston is slidably disposed within the internal chamber, wherein the piston divides the internal chamber into upper and lower chamber; wherein the device is in the first position when the piston is disposed within the upper chamber and in the second position when the piston is disposed within the lower chamber;

a control valve including an inlet port, an outlet port, an exhaust port and a biasing member; the control valve selectively enables fluid communication between the device and the source of pressurized fluid;

an upper sensing valve including a mechanical actuator, an inlet port, an outlet port and a biasing member;

a lower sensing valve including a mechanical actuator, an inlet port, an outlet port, an exhaust port and a biasing member;

an upper control valve including an inlet port, an outlet port, an exhaust port and a biasing member; the upper control valve displaces the device to the second position in response to the control valve enabling fluid communication between the device and the source of pressurized fluid;

a lower control valve including an inlet port, an outlet port, an exhaust port and a biasing member; the lower control valve displaces the device to the first position in response to the control valve preventing fluid communication between the device and the source of pressurized fluid;

a monitoring valve including a plurality of ports in selective fluid communication with one another; the monitoring valve selectively exhausts pressurized fluid; and a latching mechanism positioned externally with respect to said cylinder, wherein the latching mechanism includes a latch, an inlet port and a biasing member; the latching mechanism selectively engages the piston through said cylinder in response to a loss of pressurized fluid.

12. The system according to claim 11, wherein the device further includes a pot for retaining a mass of molten material.

13. The system according to claim 11, wherein the device further comprises a plurality of crust breaking devices capable of selectively breaking a top surface of the mass of molten material.

14. The system according to claim 11, wherein each of the upper and lower control valves further include a pilot in fluid communication with the monitoring valve for actuating each of the upper and lower control valves.

15. The system according to claim 11, wherein the upper sensing valve is in operable communication with the piston and selectively actuated to enable the flow of pressurized fluid to the lower control valve.

16. The system according to claim 11, wherein the lower sensing valve is in operable communication with the piston and selectively actuated to enable the flow of pressurized fluid to the monitoring valve.

17. The system according to claim 11, wherein the biasing member of the latching mechanism is in operable communication with the latch and the source of pressurized fluid for enabling the latch to selectively engage the device.

18. The latching system according to claim 11, wherein the working portion comprises:

an outer wall, an upper end wall, and a lower end wall, wherein the outer wall includes an aperture, wherein the outer wall, upper end wall and lower end wall define the internal chamber, wherein the latch is aligned with said aperture, wherein the latch selectively engages the piston through said aperture.

19. The latching system according to claim 11, wherein the latch is selectively capable of engaging the piston within said internal chamber.

20. A latching system for a device capable of moving from a first position to a second position in response to fluid pressure from a source of pressurized fluid comprising:

a cylinder including an aperture, wherein a piston is slidably-disposed within an internal chamber defined by said cylinder;

a latch in selective communication with the device by way of the piston, wherein the latch engages the piston through said aperture formed in the cylinder, wherein the latch is in selective communication with the source of pressurized fluid, the latch being held in the first position during a static mode of operation, a driving mode of operation, and a return mode of operation of the crust breaking device; and a biasing member in operable communication with the latch and the source of pressurized fluid, the biasing member being held in a first position by the force exerted from the source of pressurized fluid during the static mode of operation, the driving mode of operation, and the return mode of operation of the crust breaking device;

wherein the biasing member moves to the second position when the source of pressurized fluid is below a predetermined pressure, thereby causing the latch to engage the device.

21. The latching system according to claim 20, wherein the device further comprises a plurality of crust breaking devices capable of selectively breaking a top surface of a mass of molten material.

22. The latching system according to claim 20, wherein the cylinder further comprises:

an outer wall, an upper end wall, and a lower end wall, wherein the outer wall includes said aperture, wherein the outer wall, upper end wall and lower end wall define said internal chamber, wherein the latch is aligned with said aperture, wherein the latch selectively engages the piston through said aperture.

23. The latching system according to claim 22, wherein the latch is positioned proximate the outer wall and externally with respect to said cylinder.

24. The latching system according to claim 20, wherein the latch is selectively capable of engaging the piston within said internal chamber.

* * * * *